United States Patent [19]

Knechtel

[11] Patent Number: 4,541,705

[45] Date of Patent: Sep. 17, 1985

[54] COPYING APPARATUS HAVING TWO SEPARATE FUSING STATIONS FOR REPEATED IMAGE PROCESSING ON A COPY SHEET

[75] Inventor: Wilhelm Knechtel, Biebertal, Fed. Rep. of Germany

[73] Assignee: Canon Kabushiki Kaisha, Tokyo, Japan

[21] Appl. No.: 516,964

[22] Filed: Jul. 25, 1983

[30] Foreign Application Priority Data

Aug. 3, 1982 [DE] Fed. Rep. of Germany ..... 3228940

[51] Int. Cl.[4] ..... G03G 15/20

[52] U.S. Cl. ..... 355/3 FU; 219/216; 432/60

[58] Field of Search ..... 355/3 FU, 14 FU, 3 R; 219/216, 388; 432/60

[56] References Cited

U.S. PATENT DOCUMENTS

| | | | |
|---|---|---|---|
| 3,187,162 | 6/1965 | Hojo et al. | 355/3 FU |
| 3,679,302 | 7/1972 | Ludwig | 355/3 FU |
| 3,988,061 | 10/1976 | Root | 355/3 FU |

*Primary Examiner*—R. L. Moses

*Attorney, Agent, or Firm*—Fitzpatrick, Cella, Harper & Scinto

[57] ABSTRACT

Copying apparatus for repeated image processing on a copy sheet wherein an image is formed on one surface of a copy sheet, the sheet after which is directed to an image processing station so that an image may be formed on the other surface of the sheet, whereby image processing is repeatedly effected. The apparatus includes a final fixing device for finally completing the fixation of the printed sheet, and an intermediate fixing device for preliminarily effecting pre-fixation of the sheet before the sheet passes through the final fixing device.

8 Claims, 1 Drawing Figure

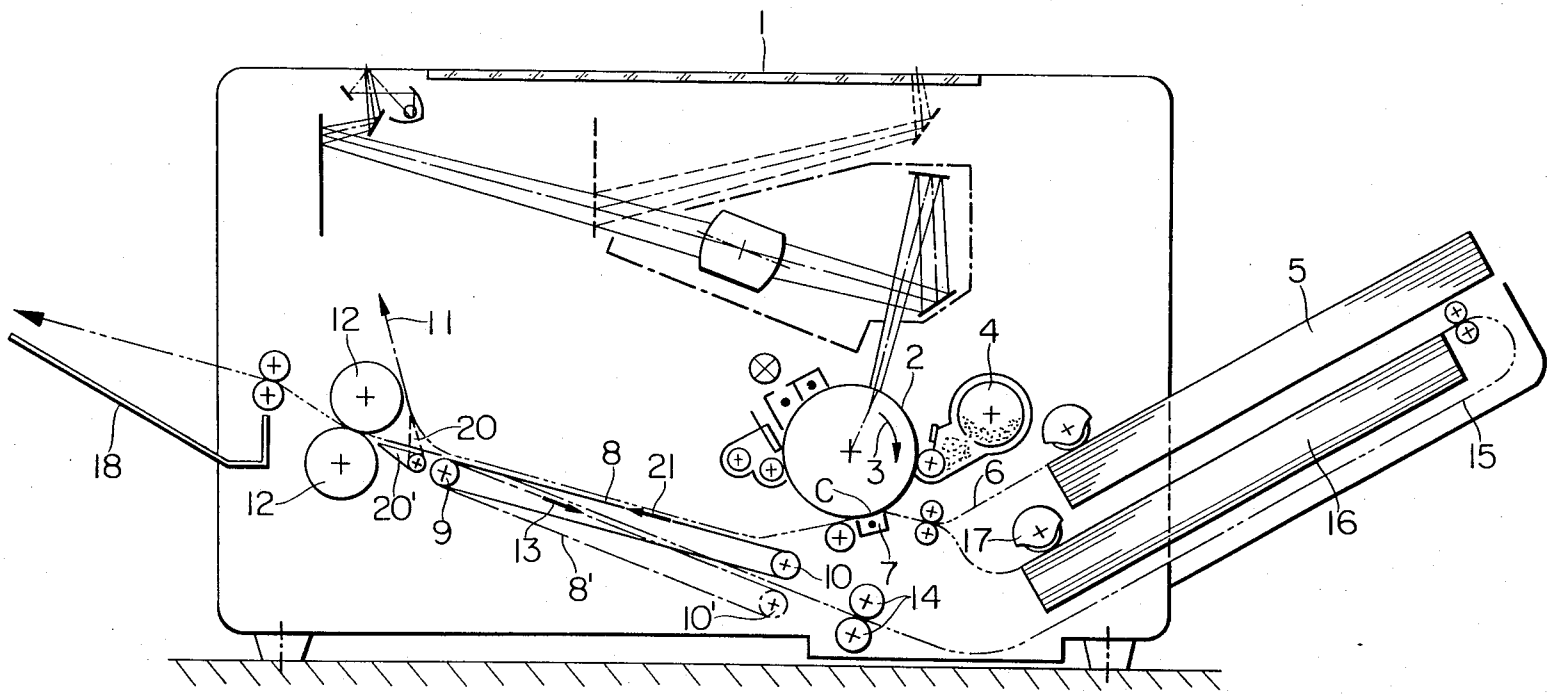
1
2
3
4
5
6
7
8
8'
9
10
10'
11
12
12
13
14
15
16
17
18
20
20'
21
C

COPYING APPARATUS HAVING TWO SEPARATE FUSING STATIONS FOR REPEATED IMAGE PROCESSING ON A COPY SHEET

BACKGROUND OF THE INVENTION

1. Field of the Invention

This invention relates to a copying apparatus in which copy paper sheets are repeatedly conveyed to an image process station in order that original images may be copied, for example, on both surfaces of the copy paper sheets.

2. Description of the Prior Art

In an apparatus belonging to such a kind of technical level, in order to make, for example, both-surface multicopies, one surface of an original is first repeatedly projected onto a process cylinder and an electrostatic latent image of the original formed thereon is developed, whereafter the developed image is transferred onto one surface of copy paper sheets continuously passing by the process cylinder and these sheets are fixed and then collected as one-surface copies in an intermediate magazine. Thereafter, the original is reversed and now the image of the back surface of the original is formed on the process cylinder. The copy paper sheets having one surface thereof printed are called back from the intermediate magazine and the back surfaces thereof are placed on the process cylinder, whereby there are now obtained both-surface copies. First making a copy of the front surface of a copy paper sheet and then making a copy on the back surface of the copy paper sheet seems to be costly because two "final fixations" are effected on the copy paper sheet. If fixed a copy paper sheet having one surface thereof printed is omitted, there is a danger of the dust image on the copy paper sheet being erased. Particularly, in an apparatus belonging to such kind of technical level, a feeding roller for again feeding a copy paper sheet having a copy on one surface thereof from the intermediate magazine grasps the one printed surface of the copy paper sheet. Thus, the roller becomes stained and this is inconvenient to feed out the copy paper sheet having one surface thereof printed while, on the other hand, the roller becomes awkward to handle. In addition, such stain of the feeding roller adversely affects the beauty of copies.

SUMMARY OF THE INVENTION

In view of the above-noted disadvantages, the present invention has for its object to provide an improved novel copying apparatus in which image processing is repeatedly effected.

That is, the main task of the present invention is to improve the apparatus of such type to eliminate the necessity of two final fixations and to maintain the re-feeding roller clean and accordingly ensure good friction force of the re-feeding roller for a longer period of time and thereby eliminate stain of copy sheets.

The main construction of the present invention consists in a copying apparatus in which, after an image is formed on one surface of a sheet, the sheet having one surface thereof printed is directed to an image processing station so that an image may be formed on the other surface of the sheet, whereby image processing is repeatedly effected, the copying apparatus having a final fixing device for finally completing the fixation of the printed sheet, and an intermediate fixing device for preliminarily effecting the prefixation of the sheet before the sheet passes through the final fixing device.

According to the construction of the present invention as described above, the feeding roller does not become stained by the copy sheet having one surface thereof printed being subjected to the intermediate fixation and accordingly, the copy sheet is conveyed while being kept clean. Further, the intermediate fixing device need not be as costly as the final fixing device and may be simple in structure. This is because, for example, in the case of pressure fixation, the intermediate fixing device is adapted to lightly press the toner on the sheet and according can be operated by a slight pressure.

Also, in the case of heat fixation, the intermediate fixing device can be operated simply by imparting weak heat to a sheet.

In addition, according to the present invention, there is an advantage that the path for copy paper passing through the apparatus is much shorter. The path for copy paper becomes particularly shorter where a reciprocally movable endless belt is provided behind the process station so that copy paper sheets coming from the process station are received by the belt and are transported to an intermediate magazine after the direction of movement thereof has been changed. Thereby, the possibility of erroneous feeding of copy paper sheets may be greatly reduced.

Thus, in the apparatus according to the present invention, both-surface copies, multiplex copies, multiplex color copies, etc. can be produced at a slight technical cost as a rule. The direction of movement of copy paper sheets can be changed by providing an endless belt and accordingly, placing copy paper sheets in the intermediate magazine with the image bearing side thereof facing downwardly can be accomplished by suitably forming a paper feeding path.

More detailed construction of the present invention will become apparent from the following detailed description of an embodiment thereof taken in conjunction with the accompanying drawing.

BRIEF DESCRIPTION OF THE DRAWING

The drawing is a longitudinal cross-sectional view showing an embodiment of the present invention.

DESCRIPTION OF THE PREFERRED EMBODIMENT

An original placed on a glass plate 1 is projected in the form of a slit onto a process cylinder 2 by the use of well-known optical means and an electrostatic latent image corresponding to the image of the underside of the original is formed on the cylinder 2. The process cylinder 2 is rotated in the direction of arrow 3 and accordingly, the electrostatic latent image passes by a developing device 4 and a dust image corresponding to the image of the underside of the original is formed on the process cylinder 2. A copy paper sheet is taken out from a cassette 5 and fed to an image transfer station C along a feeding path 6 shown by dot-and-dash line. By the action of a transfer corona charger 7, the dust image on the process cylinder is transferred onto the passing copy paper. The copy paper having left the process cylinder 2 is placed onto an endless belt 8 which moves around rollers 9 and 10 in the direction of arrow 21. The copy paper sheet is held on the belt 8 by a suction device, not shown, or other means. If the copy paper sheet is very long and accordingly the leading end edge thereof separates from the belt 8, the copy paper sheet does not arrive at a final fixing device such as a pair of rollers 12 or a heating device and a switch member 20 bends the leading end portion of the copy paper sheet in the direction of arrow 11 so that the copy paper sheet is not separated from the belt 8 by a roller provided at the final fixing device. As soon as the end edge of the copy paper sheet rides onto the belt 8, the belt 8 swings to a position 8' indicated by dot-and-dash line, that is, a roller 10 shifts to a position 10'. At such time, the belt 8 changes its direction of movement, that is, it moves in the direction of arrow 13 and feeds the copy paper to an intermediate fixing device 14. This intermediate fixing device lightly compresses the developer powder or, in the case of heat fixation, imparts weak heat thereto and accordingly, the image on the copy paper sheet is not erased even during the subsequent conveyance and working processes. The copy paper sheet, after having left the intermediate fixing device, moves toward a conveyance path 15 indicated by dot-and-dash line and enters an intermediate magazine 16 and is placed therein. In the meantime, a new image of the underside of the original is formed on the process cylinder 2, and a new copy paper sheet is taken out from the cassette 5 and this sheet is conveyed by the belt 8 and likewise placed into the intermediate magazine 16.

When the front surface of the original is copied on a desired number of copy paper sheets in this manner, the original is rotated on the glass plate 1 and now the dust image of the back surface thereof is formed on the process cylinder 2. At this time, a copy paper sheet having one surface thereon coated is fed from the intermediate magazine 16 to the image transfer station C by a feed roller 17 and accordingly, the dust image of the back surface of the original is formed on the back surface of the copy paper sheet. After the switch member 20 has shifted to a position 20', the conveyor belt 8 feeds this copy paper sheet directly to the final fixing device 12 using pressure or heat and thus, the images on the front and back surfaces of the copy paper sheet are finally fixed. The resultant both-surface printed copy is received into a receiving tray 18.

This process is repeated by the number of times corresponding to the number of copy paper sheets having one surface thereof coated which are contained in the intermediated magazine 16.

Although the embodiment of the present invention has been described with respect to a both-surface copying apparatus, the present invention is also applicable to an image forming apparatus or the like in which image formation is repeatedly effected, such as a multiplex copying apparatus or a color copying apparatus in which image formation is repeatedly effected on the same surface of a sheet.

What I claim is:

1. A both-side image formation apparatus for forming images on a front surface and a back surface of a sheet, comprising:

image forming means for guiding the sheet fed from a sheet stacking bed to an image processing station to form an image on the front surface of the sheet, then reversing the sheet and directing the reversed sheet to said image processing station to form an image on the back surface of the sheet; and fixing means fixing the images formed on the sheet by said image processing station;

said fixing means including means for processing the sheet on the front surface on which an image is formed at a weak fixation condition, and said fixing means further processing the sheet on the back surface on which an image is formed in addition to the front surface thereof at a stronger fixation condition than the weak fixation condition.

2. A both-side image formation apparatus according to claim 1, wherein said fixing means comprises a pair of rollers.

3. A both-side image formation apparatus according to claim 1, wherein said fixing means effects the fixation by heat.

4. A both-side image formation apparatus according to claim 1, wherein said fixing means effects the fixation by pressure.

5. A both-side image formation apparatus according to claim 1, wherein said fixing means is disposed in sheet transportation paths for one-side image formation and for both-side image formation.

6. A both-side image formation apparatus according to claim 1, wherein said image forming means comprises an intermediate magazine.

7. A both-side image formation apparatus according to claim 1, wherein said stronger fixation condition is effected by the application of a higher level of heat than the weak fixation condition.

8. A both-side image formation apparatus according to claim 1, wherein said stronger fixation condition is effected by the application of higher pressure than the weak fixation condition.

* * * * *

UNITED STATES PATENT AND TRADEMARK OFFICE

CERTIFICATE OF CORRECTION

PATENT NO. : 4,541,705

DATED : September 17, 1985

INVENTOR(S) : WILHELM KNECHTEL

It is certified that error appears in the above-identified patent and that said Letters Patent is hereby corrected as shown below:

In the Abstract, line 3, "the sheet after which" should read --after which the sheet--.

Column 1, line 10, "image process station" should read --image processing station--.

Column 1, line 35, "fixed" should read --fixing--.

Column 2, line 13, "according" should read --accordingly--.

Column 3, line 31, "thereon" should read --thereof--; line 45, "intermediated" should read --intermediate--.

Signed and Sealed this

*Twelfth* Day of *August 1986*

[SEAL]

*Attest:*

*Attesting Officer*

DONALD J. QUIGG

*Commissioner of Patents and Trademarks*